US010508891B2

(12) United States Patent
Tibeau

(10) Patent No.: US 10,508,891 B2
(45) Date of Patent: Dec. 17, 2019

(54) STOPPAGE-INDUCING AMMUNITION CARTRIDGE

(71) Applicant: Quint Gregory Tibeau, Lake Tapps, WA (US)

(72) Inventor: Quint Gregory Tibeau, Lake Tapps, WA (US)

( * ) Notice: Subject to any disclaimer, the term of this patent is extended or adjusted under 35 U.S.C. 154(b) by 0 days.

(21) Appl. No.: 16/211,173

(22) Filed: Dec. 5, 2018

(65) Prior Publication Data

US 2019/0178614 A1 Jun. 13, 2019

Related U.S. Application Data

(60) Provisional application No. 62/597,574, filed on Dec. 12, 2017.

(51) Int. Cl.

| | |
|---|---|
| ***F42B 5/28*** | (2006.01) |
| ***F42B 8/02*** | (2006.01) |
| ***F41A 33/00*** | (2006.01) |
| *F41A 15/00* | (2006.01) |

(52) U.S. Cl.

CPC ..... *F42B 5/28* (2013.01); *F41A 33/00* (2013.01); *F42B 8/02* (2013.01); *F41A 15/00* (2013.01)

(58) Field of Classification Search

CPC ..... F42B 5/28; F42B 8/02; F42B 8/08
USPC ..... 102/444, 464
See application file for complete search history.

(56) References Cited

U.S. PATENT DOCUMENTS

| | | | | | |
|---|---|---|---|---|---|
| 2,882,821 | A * | 4/1959 | Benson | F42B 8/08 | 102/444 |
| 3,027,840 | A * | 4/1962 | Hannas | F42B 8/08 | 102/444 |
| 5,094,169 | A * | 3/1992 | Evitts | F42B 5/26 | 102/464 |
| 5,291,832 | A * | 3/1994 | Plummer | F42B 8/08 | 102/444 |
| 5,315,778 | A * | 5/1994 | Wolford | F41A 17/44 | 102/511 |

(Continued)

OTHER PUBLICATIONS

S.T. Action Pro, Inc., "Action Trainer Dummy Round," http://www.stactionpro.com/, (c) 2018, Accessed Sep. 22, 2018.

(Continued)

*Primary Examiner* — Joshua E Freeman
(74) *Attorney, Agent, or Firm* — Bennet K. Langlotz; Langlotz Patent & Trademark Works, LLC

(57) ABSTRACT

Stoppage-inducing ammunition cartridges have a case having a rear head surface, a circumferential extractor groove forward of the rear head surface, a body portion forward of the circumferential extractor groove defining a case axis perpendicular to the rear head surface, and a forward mouth, a primer received in the case, a propellent within the case, a bullet received in the forward mouth, and the circumferential extractor groove being defined in part by a rear extractor surface angularly disposed with respect to a plane perpendicular to the case axis, such that an extractor adapted to engage a groove surface perpendicular to the case axis will have limited effect at extracting the cartridge from a firearm chamber after discharge. The rear extractor surface may be a frustoconical surface. The rear extractor surface may be a tapered surface acutely angled with respect to the case axis.

12 Claims, 4 Drawing Sheets

(56) References Cited

U.S. PATENT DOCUMENTS

| | | | | |
|---|---|---|---|---|
| 6,189,454 | B1 * | 2/2001 | Hunt | F42B 12/74 102/444 |
| 6,305,290 | B1 * | 10/2001 | Stimmell | F42B 8/08 102/439 |
| 8,365,669 | B1 * | 2/2013 | Saxby | F42B 8/02 102/430 |
| 9,423,221 | B2 * | 8/2016 | Bonner | F42B 8/08 |
| 10,082,375 | B2 * | 9/2018 | McCloy | F42B 8/08 |
| 2014/0096427 | A1 * | 4/2014 | Bonner | F42B 8/08 42/90 |
| 2017/0363398 | A1 * | 12/2017 | McCloy | F42B 8/08 |
| 2018/0195843 | A1 * | 7/2018 | Gerfin | F41A 33/00 |
| 2018/0259307 | A1 * | 9/2018 | Billings | F42B 8/08 |
| 2019/0017788 | A1 * | 1/2019 | McCloy | F42B 8/08 |

OTHER PUBLICATIONS

Range Systems, Inc., "Hard Malfunction Handgun Training Tool Black," https://www.range-systems.com/product/hard-malfunction-training-tool-black/, (c) 2018, Accessed Sep. 22, 2018.

* cited by examiner

STOPPAGE-INDUCING AMMUNITION CARTRIDGE

CROSS-REFERENCE TO RELATED APPLICATION

This application claims the benefit of U.S. Provisional Patent Application No. 62/597,574 filed on Dec. 12, 2017, entitled "STOPPAGE INDUCING CARTRIDGE," which is hereby incorporated by reference in its entirety for all that is taught and disclosed therein.

FIELD OF THE INVENTION

The present invention relates to firearms and more particularly to a stoppage-inducing ammunition cartridge.

BACKGROUND OF THE INVENTION

Most semi-automatic pistols' cycle of operation consists of feeding, chambering, locking, firing, unlocking, extracting, and ejecting a prior art cartridge 10 (shown in FIG. 1). The cartridge has a case head 12, extractor groove 14, body 16 that typically holds the powder charge, and bullet 18. During this process, the extractor 24 and breech face (not shown) interact with the case head and extractor groove. In feeding, the back 20 of the case head slides up the breech face as the pistol's slide (not shown) moves forward. The lip 22 of the cartridge case head slides between the breech face and the extractor, with the extractor riding in the extractor groove. Thus, the extractor holds the cartridge against the breech face. The breech face pushes the back of the case head forward, and the extractor helps to align the cartridge case as the cartridge case is chambered. The breech face and extractor continue to hold the cartridge case in place during the locking and firing process. As the pistol barrel unlocks from the slide, the extractor continues to hold onto the case head. Once the pistol's slide moves rearward, the extractor pulls the cartridge case from the chamber. When the slide nears the end of its rearward travel, the case head strikes the ejector (not shown), which is typically located on the opposite side from the extractor. Contact with the ejector forces the cartridge to stop moving rearward on that side. Since the extractor is still pulling from the opposite side, the case head moves away from the breech face on the ejector side. Continued outward force is transferred onto the extractor until the extractor can no longer maintain its hold on the case head, and the cartridge is ejected. The fit between the case head, extractor groove, and the extractor is essential for the proper cycling of the pistol.

A semi-automatic firearm's cycle of operation can be interrupted by numerous failures, which are generally cleared by one of two techniques. Expertise in these clearing techniques is essential to anyone relying on a semi-automatic firearm for protection. Law enforcement officers and other trained professionals practice these clearing techniques on a regular basis to ensure their proficiency. Various products have been developed to facilitate training in these clearing techniques.

The Action Trainer Dummy Round manufactured by S.T. Action Pro, Inc. of Coca, Fla. simulates a failure to fire malfunction. The failure to fire malfunction is easily created by inserting the Action Trainer Dummy Round into a magazine. When the Action Trainer Dummy Round is chambered, it will not discharge because it is an inert round. The shooter uses the tap/rack clearing technique by tapping the magazine's baseplate to ensure the magazine is properly positioned and then racking the slide to clear the chamber and cycle a new round. However, when the Action Trainer Dummy Round is used to simulate a failure to extract malfunction, shooters must hand place the dummy round in the chamber, then let the slide go forward on a magazine containing additional cartridges, live or dummy. This forces the next round from the magazine into the back of the dummy round in the chamber. Then, the shooter must place the gun in a shooting position and pretend they were in the middle of a course of fire when the malfunction occurred. Then the shooter practices clearing the malfunction. This leads to unrealistic training that becomes cumbersome and ineffective.

The Hard Malfunction Device manufactured by Range Systems, Inc. of New Hope, Minn. is placed in the bottom of a magazine to cause a full stoppage of a firearm occur during a course of fire to simulate a double feed or failure to extract malfunction. The Hard Malfunction Device is not a cartridge and cannot be cleared with the tap/rack technique. Instead, the device forces the shooter to remove and discard the magazine it is in. This is again an unrealistic training method, as this type of stoppage may occur with a loaded magazine that is of value to the shooter.

Another way of producing a failure to extract malfunction is to file down the hook 26 on the pistol's extractor so the hook cannot grab onto the cartridge case head correctly. This approach has the disadvantage of requiring an armorer to swap the pistol's extractor or for a trainee to use a designated pistol with a malfunctioning extractor to run this drill. It also limits what else can be accomplished at the same time since the stoppage cannot be limited to just one round (all rounds are affected).

Therefore, a need exists for a new and improved stoppage-inducing ammunition cartridge that discharges the same as a conventional live cartridge, but subsequently creates a failure to extract malfunction that enables realistic training of the clearing technique. In this regard, the various embodiments of the present invention substantially fulfill at least some of these needs. In this respect, the stoppage-inducing ammunition cartridge according to the present invention substantially departs from the conventional concepts and designs of the prior art, and in doing so provides an apparatus primarily developed for the purpose of providing a training ammunition cartridge that discharges the same as a conventional live cartridge, but subsequently creates a failure to extract malfunction that enables realistic training of the clearing technique.

SUMMARY OF THE INVENTION

The present invention provides an improved stoppage-inducing ammunition cartridge, and overcomes the above-mentioned disadvantages and drawbacks of the prior art. As such, the general purpose of the present invention, which will be described subsequently in greater detail, is to provide an improved stoppage-inducing ammunition cartridge that has all the advantages of the prior art mentioned above.

To attain this, the preferred embodiment of the present invention essentially comprises a case having a rear head surface, a circumferential extractor groove forward of the rear head surface, a body portion forward of the circumferential extractor groove defining a case axis perpendicular to the rear head surface, and a forward mouth, a primer received in the case, a propellent within the case, a bullet received in the forward mouth, and the circumferential extractor groove being defined in part by a rear extractor surface angularly disposed with respect to a plane perpendicular to the case axis, such that an extractor adapted to engage a groove surface perpendicular to the case axis will have limited effect at extracting the cartridge from a firearm chamber after discharge. The rear extractor surface may be a frustoconical surface. The rear extractor surface may be a tapered surface. The tapered surface may be acutely angled with respect to the case axis. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
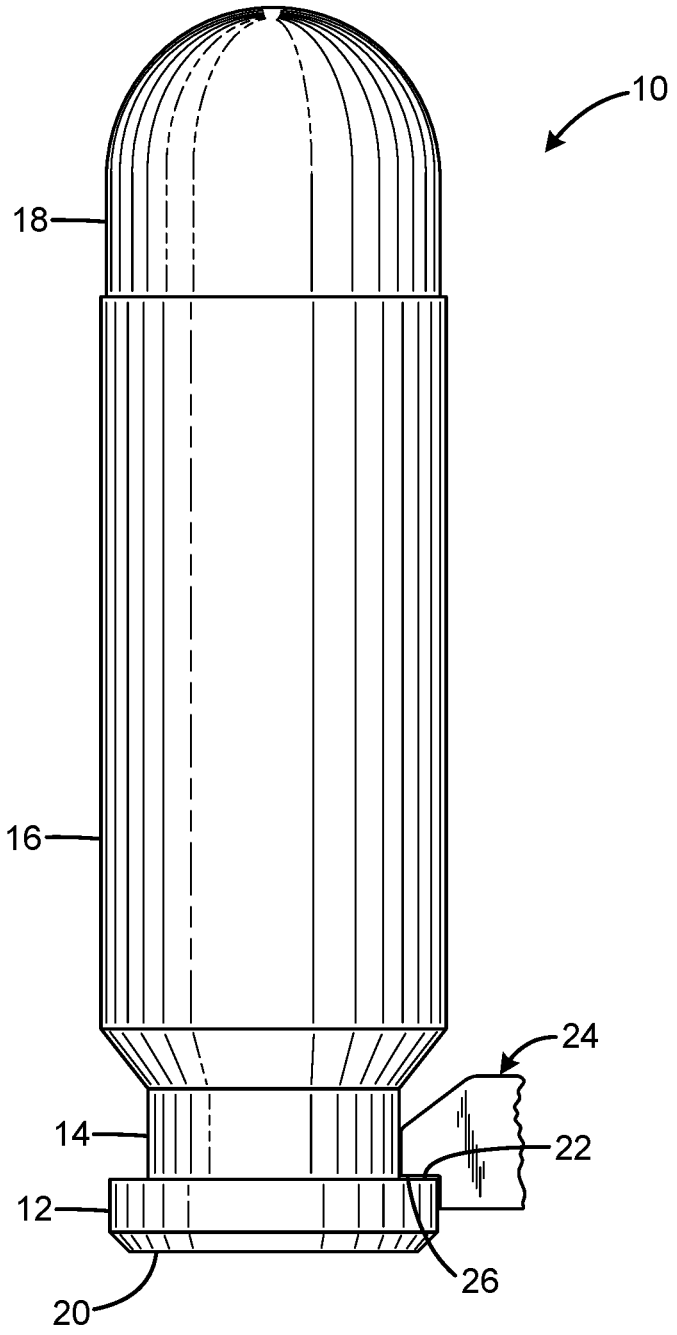
FIG. 1 PRIOR ART
FIG. 1 is a side view of a prior art ammunition cartridge.

An embodiment of the stoppage-inducing ammunition cartridge of the present invention is shown and generally designated by the reference numeral 100.

Figure 2:
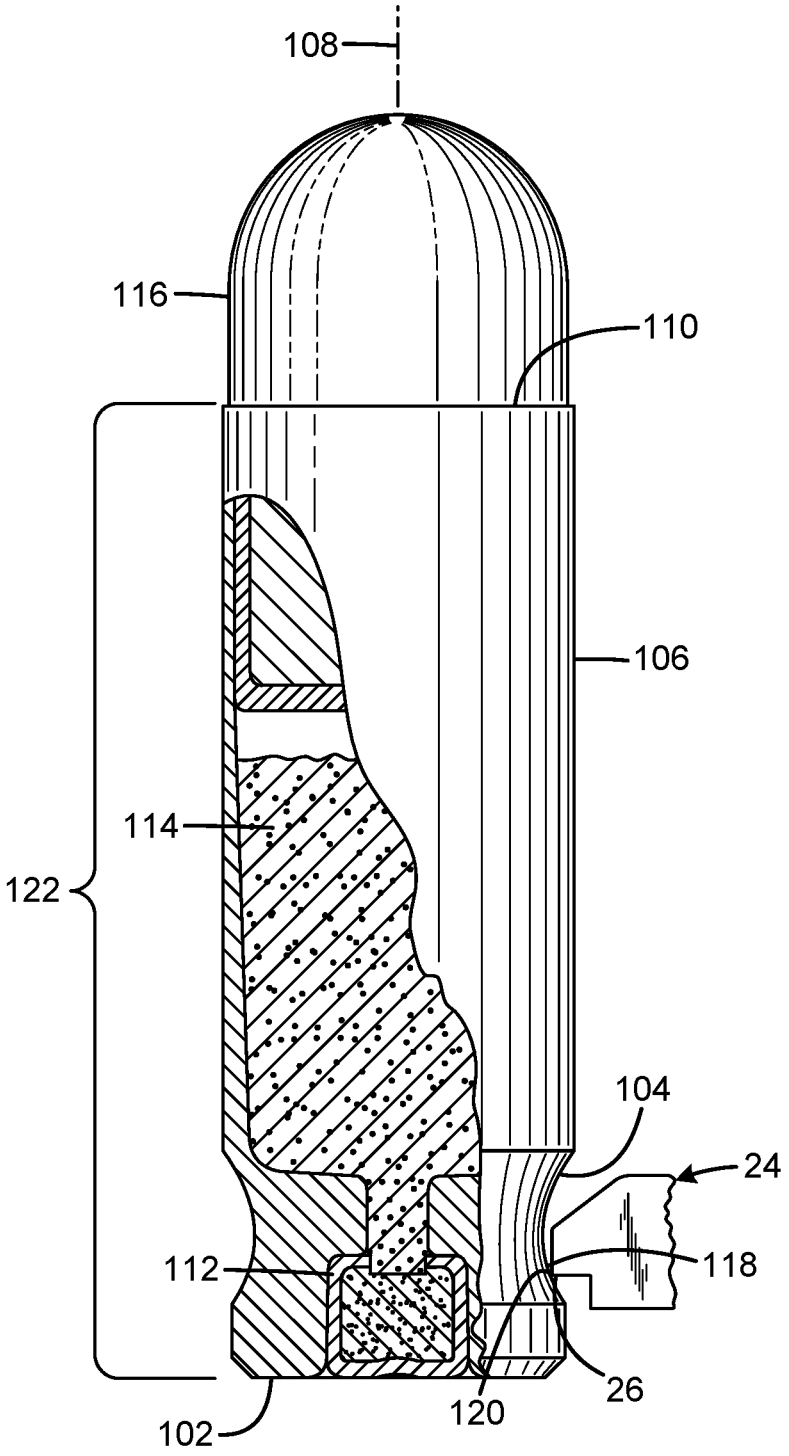
FIG. 2 is a side cutaway view of the current embodiment of the stoppage-inducing ammunition cartridge constructed in accordance with the principles of the present invention.

FIG. 2 illustrates the improved stoppage-inducing ammunition cartridge 100 of the present invention. More particularly, the stoppage-inducing ammunition cartridge has a case 122 having rear head surface 102, a circumferential extractor groove 104 forward of the rear head surface, a body portion 106 forward of the circumferential extractor groove defining a case axis 108 perpendicular to the rear head surface, and a forward mouth 110. A primer 112 is received in the rear head surface and exposed to be accessible by a firing pin (not shown). A propellant 114 is received within the case. A bullet 116 is received in the forward mouth of the case. The circumferential extractor groove is defined in part by a rear extractor surface 118 angularly disposed with respect to a plane perpendicular to the case axis, such that an extractor 24 having a hook 26 adapted to engage a groove surface 120 perpendicular to the case axis will have limited effect at extracting the cartridge from a firearm chamber (not shown) after discharge. The rear extractor surface is a surface of revolution having a concave profile in a plane passing through the case axis. The rear extractor surface can also be a concave toroidal surface. For the .40 S&W/.357 Sig and .45 ACP cartridges, the stoppage-inducing ammunition cartridge works best across multiple handgun manufacturers when the depth of the circumferential extractor groove is between 0.0035-0.009 inch.

It should be appreciated that the primer 112, propellant 114, and bullet 116 enable the stoppage-inducing ammunition cartridge 100 to fire exactly like prior art ammunition cartridge 10 with the shooter experiencing a normal sense of recoil. Thus, the shooter has no warning that the stoppage-inducing ammunition cartridge has been chambered until a failure to extract malfunction is experienced when the firearm attempts to chamber another round as the firearm cycles after discharge. The rear extractor surface 118 and groove surface 120 are changed relative to the extractor groove 14 of prior art ammunition cartridge 10 to remove the lip 22, which is a flat surface the hook 26 of the extractor 24 pulls against. However, the rear extractor surface and groove surface of the stoppage-inducing ammunition cartridge 100 still permit the hook to get some purchase on the groove surface so the case 122 can be removed during the clearing process. However, the limited purchase of the hook on the grooves surface prevents the extractor from properly and completely removing the case during the violent cycling process following discharge of the stoppage-inducing ammunition cartridge 100. This limited effect of the extractor at extracting the case from a firearm chamber after discharge creates a realistic failure to extract malfunction for training purposes.

Figure 3:
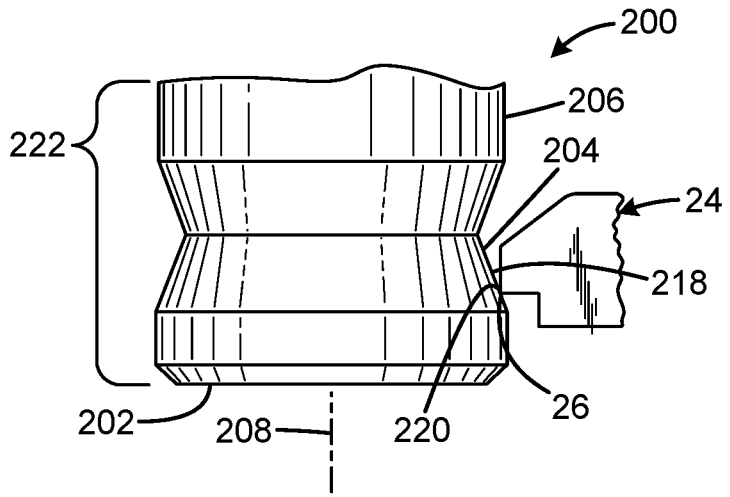
FIG. 3 is a side fragmentary view of the first alternative embodiment of the stoppage-inducing ammunition cartridge constructed in accordance with the principles of the present invention.

FIG. 3 illustrates a first alternative embodiment of the improved stoppage-inducing ammunition cartridge 200 of the present invention. More particularly, the stoppage-inducing ammunition cartridge has a case 222 having rear head surface 202, a circumferential extractor groove 204 forward of the rear head surface, a body portion 206 forward of the circumferential extractor groove defining a case axis 208 perpendicular to the rear head surface, and a forward mouth (not shown). A primer (not shown) is received in the rear head surface and exposed to be accessible by a firing pin (not shown). A propellant (not shown) is received within the case. A bullet (not shown) is received in the forward mouth of the case. The circumferential extractor groove is defined in part by a rear extractor surface 218 angularly disposed with respect to a plane perpendicular to the case axis, such that an extractor 24 having a hook 26 adapted to engage a groove surface 220 perpendicular to the case axis will have limited effect at extracting the cartridge from a firearm chamber (not shown) after discharge. The rear extractor surface is a frustoconical, tapered surface that is acutely angled with respect to the case axis. The rear extractor surface is angularly offset from the body axis by at least 1° and is angularly offset from the body axis by at most 45°.

For a 9 mm Luger cartridge when cutting the dimensions of the circumferential extractor groove 204, leaving the smallest most diameter between 0.325 and 0.331 inch and using an angle between 6° and 8° gives the best performance in most service pistols. The thickness of the rear head surface 202 as it relates to the distance between the rear head surface 202 and the forwardmost portion of groove surface 220 works best between 0.030 and 0.040 inch with no lead in taper. These ranges generate the most reliable rates of desired malfunctions, with the least rate of undesired stoppages that require tools to extract a stuck cartridge. Using these dimensions may incur a disadvantage in the manufacturing process as the case head exterior may be smaller than the case mouth interior and cause cases to be telescopically engaged or stuck when processed in bulk. Measures may need to be taken to avoid this to enjoy the benefits of cartridges with this relationship of case head and mouth diameter.

The .40 S&W/.357 Sig and .45 ACP cartridges react differently, allowing a larger angular deviation from about 10° up to slightly less than 90° if the depth of the rear extractor surface 218 where the extractor 24 interacts with it is between 0.0035-0.009 inch when measured at 90° from the rear head surface 202. When the width of the rear extractor surface is reduced, the angle may be closer to 90°.

It should be appreciated that the primer, propellant, and bullet enable the stoppage-inducing ammunition cartridge 200 to fire exactly like prior art ammunition cartridge 10 with the shooter experiencing a normal sense of recoil. Thus, the shooter has no warning that the stoppage-inducing ammunition cartridge has been chambered until a failure to extract malfunction is experienced when the firearm attempts to chamber another round as the firearm cycles after discharge. The rear extractor surface 218 and groove surface 220 are changed relative to the extractor groove 14 of prior art ammunition cartridge 10 to remove the lip 22, which is a flat surface the hook 26 of the extractor 24 pulls against. However, the rear extractor surface and groove surface of the stoppage-inducing ammunition cartridge 200 still permit the hook to get some purchase on the groove surface so the case 222 can be removed during the clearing process. However, the limited purchase of the hook on the grooves surface prevents the extractor from properly and completely removing the case during the violent cycling process following discharge of the stoppage-inducing ammunition cartridge 200. This limited effect of the extractor at extracting the case from a firearm chamber after discharge creates a realistic failure to extract malfunction for training purposes.

Figure 4:
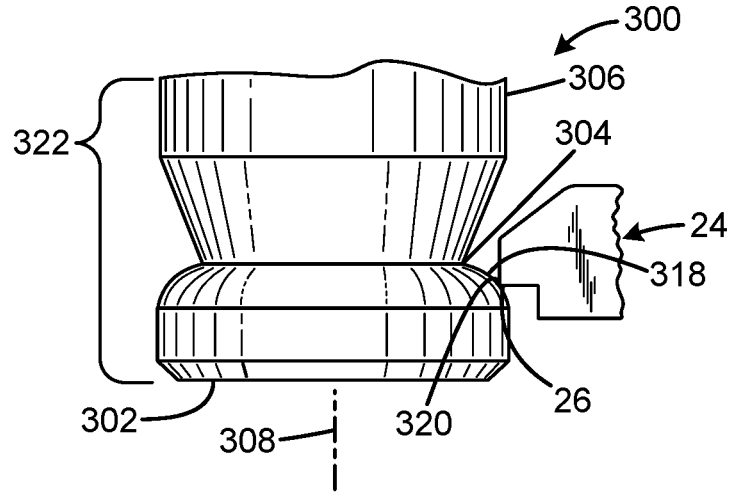
FIG. 4 is a side fragmentary view of the second alternative embodiment of the stoppage-inducing ammunition cartridge constructed in accordance with the principles of the present invention.

FIG. 4 illustrates a second alternative embodiment of the improved stoppage-inducing ammunition cartridge 300 of the present invention. More particularly, the stoppage-inducing ammunition cartridge has a case 322 having rear head surface 302, a circumferential extractor groove 304 forward of the rear head surface, a body portion 306 forward of the circumferential extractor groove defining a case axis 308 perpendicular to the rear head surface, and a forward mouth (not shown). A primer (not shown) is received in the rear head surface and exposed to be accessible by a firing pin (not shown). A propellant (not shown) is received within the case. A bullet (not shown) is received in the forward mouth of the case. The circumferential extractor groove is defined in part by a rear extractor surface 318 angularly disposed with respect to a plane perpendicular to the case axis, such that an extractor 24 having a hook 26 adapted to engage a groove surface 320 perpendicular to the case axis will have limited effect at extracting the cartridge from a firearm chamber (not shown) after discharge. The rear extractor surface is a surface of revolution having a convex profile in a plane passing through the case axis. The rear extractor surface can also be a convex toroidal surface. For the .40 S&W/.357 Sig and .45 ACP, the specific radius is not as important, as long as the depth of the rear extractor surface 318 where the extractor 24 interacts with it is between 0.0035-0.009 inch when measured at 90° from the rear head surface 302.

It should be appreciated that the primer, propellant, and bullet enable the stoppage-inducing ammunition cartridge 300 to fire exactly like prior art ammunition cartridge 10 with the shooter experiencing a normal sense of recoil. Thus, the shooter has no warning that the stoppage-inducing ammunition cartridge has been chambered until a failure to extract malfunction is experienced when the firearm attempts to chamber another round as the firearm cycles after discharge. The rear extractor surface 318 and groove surface 320 are changed relative to the extractor groove 14 of prior art ammunition cartridge 10 to remove the lip 22, which is a flat surface the hook 26 of the extractor 24 pulls against. However, the rear extractor surface and groove surface of the stoppage-inducing ammunition cartridge 300 still permit the hook to get some purchase on the groove surface so the case 322 can be removed during the clearing process. However, the limited purchase of the hook on the grooves surface prevents the extractor from properly and completely removing the case during the violent cycling process following discharge of the stoppage-inducing ammunition cartridge 300. This limited effect of the extractor at extracting the case from a firearm chamber after discharge creates a realistic failure to extract malfunction for training purposes.

Figure 5:
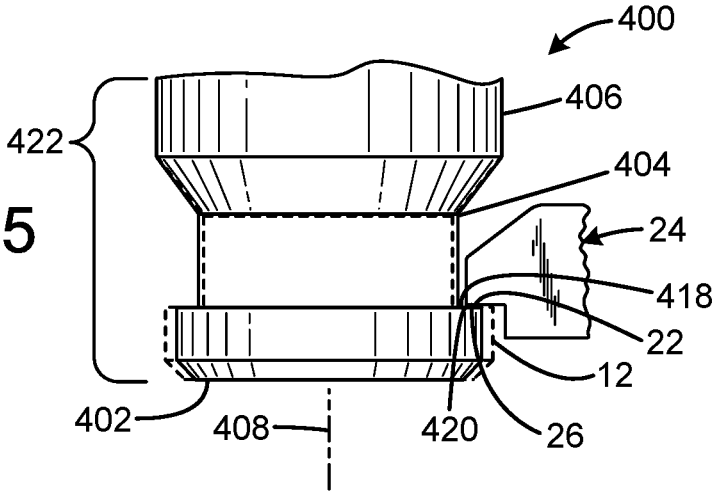
FIG. 5 is a side fragmentary view of the third alternative embodiment of the stoppage-inducing ammunition cartridge constructed in accordance with the principles of the present invention.

FIG. 5 illustrates a third alternative embodiment of the improved stoppage-inducing ammunition cartridge 400 of the present invention. More particularly, the stoppage-inducing ammunition cartridge has a case 422 having rear head surface 402, a circumferential extractor groove 404 forward of the rear head surface, a body portion 406 forward of the circumferential extractor groove defining a case axis 408 perpendicular to the rear head surface, and a forward mouth (not shown). It should be appreciated that the stoppage-inducing ammunition cartridge 400 is straight walled to the forward mouth such that the case head has a smaller exterior diameter than the interior diameter of the forward mouth. A primer (not shown) is received in the rear head surface and exposed to be accessible by a firing pin (not shown). A propellant (not shown) is received within the case. A bullet (not shown) is received in the forward mouth of the case. The circumferential extractor groove is defined in part by a rear extractor surface 418 that has a lesser diameter compared to the case head 12 with lip 22 of prior art ammunition cartridge 100 (shown in dashed lines), such that an extractor 24 having a hook 26 adapted to engage a groove surface 420 perpendicular to the case axis will have limited effect at extracting the cartridge from a firearm chamber (not shown) after discharge. The body portion has a greater diameter than the rear head surface to the rear of the circumferential extractor groove. In standard cartridges, the depth of the rear extractor surface 418 ranges between 0.0185-0.04535 inch; (9 mm Luger is between 0.0185-0.0335 inch), (.40 S&W/.357 Sig is between 0.0335-0.04535 inch), (.45 CP is between 0.035-0.045 inch). For the purposes of causing a reliable stoppage that can then be cleared using the proper clearing technique, the range needs to be reduced to between about 0.0035-0.009 inch. Cartridges chambered in 9 mm Luger tend to still extract even with this reduced surface area. This may be in part because the body of the standard 9 mm cartridge case is more significantly tapered throughout its length, being smaller at the case mouth than near the extractor groove 404. As above, the embodiment illustrated in FIG. 5 also causes an issue with manufacturing as the largest diameter of the rear head surface 402 is smaller than the inside dimensions of the forward mouth of the case, allowing the cartridges to cup, or stack into each other during the ammunition manufacturing process. In alternative embodiments, the smaller rear head surface can be combined with a sloped or curved rear extractor surface.

For standard cartridges, the mouth interior on a 9 mm Luger cartridge is 0.3555-0.0030, while the head diameter is 0.394-0.010; the mouth interior on a .40 S&W cartridge is 0.4005-0.0030, while the head diameter is 0.424-0.010; and the mouth interior on a .45 ACP cartridge is 0.4520-0.0030 (w/jacketed bullet), while the head diameter is 0.480-0.010. The stoppage-inducing ammunition cartridge 400 variant for .40 S&W has a reduced exterior rear head diameter of 0.353-0.002. Similar reductions in the exterior rear head diameter are used for 9 mm Luger cartridges and .45 ACP cartridges.

It should be appreciated that the primer, propellant, and bullet enable the stoppage-inducing ammunition cartridge 400 to fire exactly like prior art ammunition cartridge 10 with the shooter experiencing a normal sense of recoil. Thus, the shooter has no warning that the stoppage-inducing ammunition cartridge has been chambered until a failure to extract malfunction is experienced when the firearm attempts to chamber another round as the firearm cycles after discharge. The rear extractor surface 418 and groove surface 420 are changed relative to the extractor groove 14 of prior art ammunition cartridge 10 to reduce the diameter of the lip 22, which is a flat surface the hook 26 of the extractor 24 pulls against. However, the rear extractor surface and groove surface of the stoppage-inducing ammunition cartridge 400 still permit the hook to get some purchase on the groove surface so the case 422 can be removed during the clearing process. However, the limited purchase of the hook on the grooves surface prevents the extractor from properly and completely removing the case during the violent cycling process following discharge of the stoppage-inducing ammunition cartridge 400. This limited effect of the extractor at extracting the case from a firearm chamber after discharge creates a realistic failure to extract malfunction for training purposes. This contrasts with a conventional cartridge having a rebated head where the head diameter is less than a cartridge diameter. In those cases, the extractor groove is formed to a depth that is enough for reliable extractor engagement.

Figure 6:
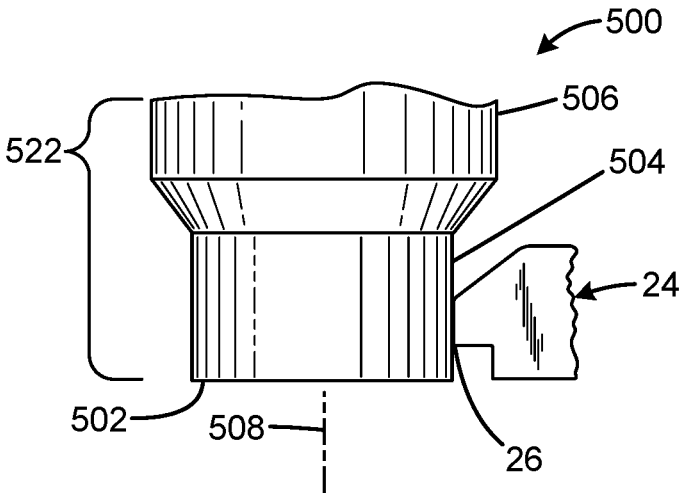
FIG. 6 is a side fragmentary view of the fourth alternative embodiment of the stoppage-inducing ammunition cartridge constructed in accordance with the principles of the present invention.

FIG. 6 illustrates a fourth alternative embodiment of the improved stoppage-inducing ammunition cartridge 500 of the present invention. More particularly, the stoppage-inducing ammunition cartridge has a case 522 having rear head surface 502, a circumferential extractor surface 504 forward of the rear head surface, a body portion 506 forward of the circumferential extractor surface defining a case axis 508 perpendicular to the rear head surface, and a forward mouth (not shown). A primer (not shown) is received in the rear head surface and exposed to be accessible by a firing pin (not shown). A propellant (not shown) is received within the case. A bullet (not shown) is received in the forward mouth of the case. The circumferential extractor surface omits a rear extractor surface angularly disposed with respect to a plane perpendicular to the case axis, such that an extractor 24 having a hook 26 adapted to engage a groove surface perpendicular to the case axis will have limited effect at extracting the cartridge from a firearm chamber (not shown) after discharge. Upon application of the clearing technique, the extractor 24 and hook 26 instead create a deformation in the rear of the rear head surface 502 and the surface of 504 with enough depth to create a rear extractor surface that can be engaged by the hook to extract the cartridge from a firearm chamber. This embodiment was created to overcome the efficiencies inherent in the cycling of 9 mm Luger semi-automatic pistols. For the 9 mm Luger cartridge, the diameter of the circumferential extractor 504 works best between 0.3535-0.3605 inch. However, to avoid cupping, or the stacking of cases during ammunition manufacturing, the minimum diameter should be kept to 0.356 inch. The angle of the circumferential extractor surface 504 can be varied from −8° to +2° relative to case axis 508 with success depending on the diameter of the circumferential extractor surface where the extractor 24 interacts with it. The best performance across pistol manufacturers is found when using 0 to +1° relative to the case axis. When this embodiment is used in Gen 4 or later Glock pistols or Heckler & Koch VP9 pistols, the cases should be nickel plated to create a harder, smoother surface to prevent the hook from digging into the circumferential extractor surface upon the initial feeding of the cartridge against the breech face and the extractor. It should also be noted that the use of a 115 gr. bullet over a heavier bullet increases the effectiveness of this embodiment.

It should be appreciated that the primer, propellant, and bullet enable the stoppage-inducing ammunition cartridge 500 to fire exactly like prior art ammunition cartridge 10 with the shooter experiencing a normal sense of recoil. Thus, the shooter has no warning that the stoppage-inducing ammunition cartridge has been chambered until a failure to extract malfunction is experienced when the firearm attempts to chamber another round as the firearm cycles after discharge. The rear extractor surface and groove surface are omitted compared to prior art ammunition cartridge 10 to remove the lip 22, which is a flat surface the hook 26 of the extractor 24 pulls against. However, as was described previously, the case 522 can be removed during the clearing process. However, the limited purchase of the hook on the circumferential extractor surface 504 prevents the extractor from properly and completely removing the case during the violent cycling process following discharge of the stoppage-inducing ammunition cartridge 500. This limited effect of the extractor at extracting the case from a firearm chamber after discharge creates a realistic failure to extract malfunction for training purposes.

Figure 7:
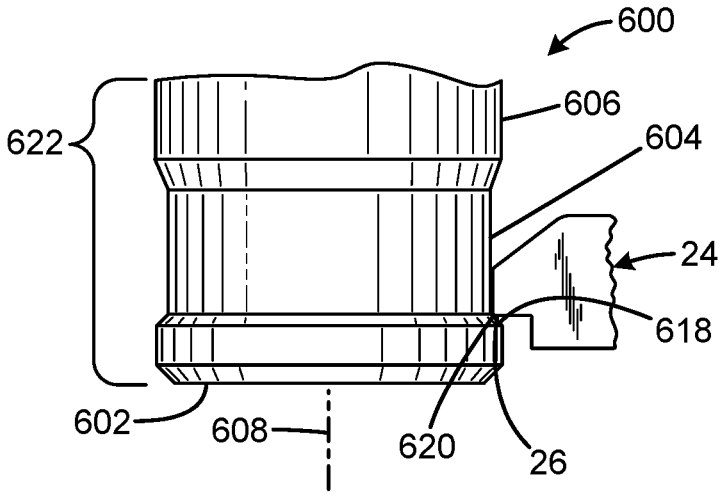
FIG. 7 is a side fragmentary view of the fifth alternative embodiment of the stoppage-inducing ammunition cartridge constructed in accordance with the principles of the present invention.

FIG. 7 illustrates a fifth alternative embodiment of the improved stoppage-inducing ammunition cartridge 600 of the present invention. More particularly, the stoppage-inducing ammunition cartridge has a case 622 having rear head surface 602, a circumferential extractor groove 604 forward of the rear head surface, a body portion 606 forward of the circumferential extractor groove defining a case axis 608 perpendicular to the rear head surface, and a forward mouth (not shown). A primer (not shown) is received in the rear head surface and exposed to be accessible by a firing pin (not shown). A propellant (not shown) is received within the case. A bullet (not shown) is received in the forward mouth of the case. The circumferential extractor groove is defined in part by a rear extractor surface 618 angularly disposed with respect to a plane perpendicular to the case axis, such that an extractor 24 having a hook 26 adapted to engage a groove surface 620 that is angled relative to the case axis will have limited effect at extracting the cartridge from a firearm chamber (not shown) after discharge.

It should be appreciated that the primer, propellant, and bullet enable the stoppage-inducing ammunition cartridge 600 to fire exactly like prior art ammunition cartridge 10 with the shooter experiencing a normal sense of recoil. Thus, the shooter has no warning that the stoppage-inducing ammunition cartridge has been chambered until a failure to extract malfunction is experienced when the firearm attempts to chamber another round as the firearm cycles after discharge. The rear extractor surface 618 and groove surface 620 are changed relative to the extractor groove 14 of prior art ammunition cartridge 10 to increase the diameter of the lip 22, which is a flat surface the hook 26 of the extractor 24 pulls against. However, the rear extractor surface and groove surface of the stoppage-inducing ammunition cartridge 600 still permit the hook to get some purchase on the groove surface so the case 622 can be removed during the clearing process. However, the limited purchase of the hook on the groove's surface prevents the extractor from properly and completely removing the case during the violent cycling process following discharge of the stoppage-inducing ammunition cartridge 600. This limited effect of the extractor at extracting the case from a firearm chamber after discharge creates a realistic failure to extract malfunction for training purposes.

All the embodiments of the stoppage-inducing ammunition cartridge can be manufactured from the same materials and using the same processes as prior art ammunition cartridge 10. The shapes of the cartridge case head and extractor groove are varied during manufacturing to conform to specific dimensions to create the various embodiments of the stoppage-inducing ammunition cartridge. If the rear extractor surface is inadequately angled or too deep, the case will be effectively extracted and not induce the desired stoppage.

While current embodiments of a stoppage-inducing ammunition cartridge have been described in detail, it should be apparent that modifications and variations thereto are possible, all of which fall within the true spirit and scope of the invention. For example, a separate groove or cut-out could be added to the area at the front of the extractor groove where the extractor groove meets the body. The additional groove would not affect the stoppage-creating performance of the stoppage-inducing cartridge as intended. Instead, the additional groove would make it easier to load the stoppage-inducing cartridges in conventional loading machines that make use of the conventional extractor groove to hold the cases in place during assembly. The additional groove would replace the traditional extractor groove on some cases to facilitate loading. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ammunition cartridge comprising:

a case having a rear head surface, a circumferential extractor groove forward of the rear head surface, a body portion forward of the circumferential extractor groove defining a case axis perpendicular to the rear head surface, and a forward mouth;

a primer received in the case;

a propellent within the case;

a bullet received in the forward mouth; and the circumferential extractor groove being defined in part by a rear extractor surface angularly disposed with respect to a plane perpendicular to the case axis, such that an extractor adapted to engage a groove surface perpendicular to the case axis will have limited effect at extracting the cartridge from a firearm chamber after discharge.

2. The ammunition cartridge of claim 1 wherein the rear extractor surface is a frustoconical surface.

3. The ammunition cartridge of claim 1 wherein the rear extractor surface is a tapered surface.

4. The ammunition cartridge of claim 3 wherein the tapered surface is acutely angled with respect to the case axis.

5. The ammunition cartridge of claim 1 wherein the rear extractor surface is a surface of revolution having a convex profile in a plane passing through the case axis.

6. The ammunition cartridge of claim 5 wherein the rear extractor surface is a convex toroidal surface.

7. The ammunition cartridge of claim 1 wherein the rear extractor surface is a surface of revolution having a concave profile in a plane passing through the case axis.

8. The ammunition cartridge of claim 7 wherein the rear extractor surface is a concave toroidal surface.

9. The ammunition cartridge of claim 1 wherein the body portion has a greater diameter than rear head surface to the rear of the circumferential extractor groove.

10. The ammunition cartridge of claim 1 wherein the rear head surface has a smaller exterior diameter than the forward mouth has an interior diameter.

11. The ammunition cartridge of claim 1 wherein the rear extractor surface is angularly offset from the body axis by at least 1°.

12. The ammunition cartridge of claim 1 wherein the rear extractor surface is angularly offset from the body axis by at most 45°.

* * * * *